US008684051B2

(12) United States Patent
Levasseur et al.

(10) Patent No.: US 8,684,051 B2
(45) Date of Patent: Apr. 1, 2014

(54) SET OF CUTTERS FOR A CANTER HEAD

(76) Inventors: Clermont Levasseur, Levis (CA); Marius Sirbu, Lévis (CA); Richard Larouche, Lévis (CA)

( * ) Notice: Subject to any disclaimer, the term of this patent is extended or adjusted under 35 U.S.C. 154(b) by 346 days.

(21) Appl. No.: 12/807,076

(22) Filed: Aug. 28, 2010

(65) Prior Publication Data

US 2011/0056587 A1 Mar. 10, 2011

(30) Foreign Application Priority Data

Sep. 9, 2009 (CA) ..... 2678934

(51) Int. Cl.
*B27G 13/00* (2006.01)

(52) U.S. Cl.
USPC ..... 144/235

(58) Field of Classification Search
USPC ..... 144/231, 235, 241
See application file for complete search history.

(56) References Cited

U.S. PATENT DOCUMENTS 4,198,883 A * 4/1980 Miller ..... 76/101.1
4,667,713 A * 5/1987 Wright ..... 144/231
5,271,442 A * 12/1993 Carpenter et al. ..... 144/220

* cited by examiner

*Primary Examiner* — Dana Ross
*Assistant Examiner* — Matthew G Katcoff

(57) ABSTRACT

The present invention relates to a cutting device for a fast canter head (20) comprising a knife holder (22) directed at an angle, a counter knife (30) with an elbow and a dorsal support (37) which positions a cutting knife (50) having a cutting angle (54). The cutting knife has a pair of adjustment recesses (52) containing an adjustment device (58). The adjustment device comprises an end of support (64) which leans against the dorsal support and works like a compensator to take into account any wear of the cutting angle of the knife for a constant distance grinding operation, in an adjustable position, making it possible to preserve a same rotation distance. The adjustment device has a railing guide (70) which slips into the adjustment recess (52) and which comprises an elastic wall (72) which pushes against the sides of the recess by the action of a tightening conical element (76) activated by a conical set screw (78). In the event of shock, the guide slips.

1 Claim, 8 Drawing Sheets

SET OF CUTTERS FOR A CANTER HEAD

BACKGROUND OF THE INVENTION

The invention is related to the field of cutting by a canter head, for wood, plastic, rubber or for the industry of recycling. A group comprising elements for tightening and variable positioning of wood cutting knives. A device providing a system of tightening and variable positioning in industry.

PRIOR ART

Various systems are used to position knives, namely:
The use of babbitt is known to maintain a position against a knife; any change implies the fusion of the babbitt, the relocalization of a cutting knife and a new casting of the babbitt in the new position.
Simonds makes use of a slide moved by two screws.
Stringer makes use of a key to a torque of 175 ft. lb.
CA2035242: Erickson shows a system for tightening using a stem with a wedge.
CA2318109: Stolz shows an element for centering, in the shape of a piston.

OBJECTIVES AND ADVANTAGES

Following the disadvantages of the known systems, the objectives of this invention are initially to offer rotational equipment which can adjust a cutting distance within thousandths and position progressively a knife of a canter head. In one or two recesses for adjustment one positions an adjustment device comprising a spreadable head sliding within a guide in a groove located on each side of the recess. Thus, when a knife is worn, it can be advanced to the original position and tightened thereon.

BRIEF DESCRIPTION OF DRAWING FIGURES

FIG. 1 is an exploded view of a canter head.
FIG. 2 is an enlarged view of a knife in position.
FIG. 3 is a perspective of an adjustment device.
FIG. 4 is a perspective of the device of FIG. 3 open.
FIG. 5 is a section of elements of tightening of the device.
FIG. 6 is a perspective of a recess in position of reception.
FIG. 7 is a perspective of an oval tightening element.
FIG. 8 is a bottom view of a curved mounting clamp.
FIG. 8A is a cut view according to line 8A-8A of FIG. 8
FIG. 8B is a cut view according to line 8B-8B of FIG. 8

DETAILED DESCRIPTION OF THE PREFERRED EMBODIMENTS

In the following description and in the accompanying drawings, the numeral numbers refer to identical parts in the various Figures.

FIG. 1 shows an exploded view of a canter head 20 comprising essential elements indicated with arrows, among which a knife holder 22 with angular orientation; one sees a support face 24, at the top of which one sees a retaining shoulder 26 for an adjustment of position of a counter knife 30 by means of a holding screw 38, which is to rest upon a back part 32 of the counter knife 30. A fine adjustment is done by means of a first adjustment screw 42, coupled to an internal adjustment screw 44 subject to a blocking nut 40. The internal adjustment screw 44 has a dual function namely that of advancing and that of retrieving the knife holder. One notices also a clearance slot 28 for flexibility.

One sees the counter knife 30 comprising an angularly orientated face 57', a long face 51', with between them an elbow 39, a back part 32 which is in position to be pushed by the holding screw 38. One sees a threaded adjustment hole 34 which receives the first adjustment screw 42. In front of the knife holder 22 one sees the holding screws 38 which will come to be pressed against the back part 32 of the counter knife. The adjustment screw 44 is used to advance or to move back the counter knife.

On one side of the knife holder 22 there is a straight mounting clamp 46 and on the other side a curved mounting clamp 48 destined to be mounted in an elbow slot 33 inside the elbow of the counter knife to fix the knife thereto. The curved mounting clamp 48 comprises an angled part 49 of concave design for tightening and centering elastic sides 59 to exert a constant pressure onto the knife by long face 51 and finishing face 57 by means of a tightening screw 45 and a curved surface 47 which is destined to be laid against an inner seat 41 of the counter knife 30. The curved mounting clamp will be used to lean against two respectively angulated parts 51, 57 of the knife when sitting on top of the counter knife, to tighten the cutting tool in place. A face of support 35 for mounting clamps and an oval locking slot 36 for tightening are shown. A dorsal support 37 will be used as a basis to regulate a position of a supported element.

The knife 50 is intended to be tightened against the counter knife 30 by means of the mounting clamps 46, 48. The knife comprises a long face 51, a curved face 56, a finishing face 57, adjustment recesses 52 and a cutting angle 54 finished by a cutting edge 53. A tightening slot 55 is used to pass tightening screws. And a second tightening slot 55' in the curved face 56 is also used to pass screws. One sees an adjustment device 58 on the long face, then a second adjustment device 58' on the finishing face, in an angled part of the knife.

FIG. 2 shows the knife 50, its cutting angle 54 terminated by a cutting edge 53 and a back of knife 60 with a wear gap 61; one notices the dorsal support 37 which in its position adds the wear gap to the width of the knife, the width of the knife being the distance between its cutting edge 53 and its back of knife 60. One sees also the oval locking slot 36. The adjustment devices 58, 58' allowing a protection against shock which corresponds to a relaxation of tightening and thus a protection against breaking of the knife. An end of support 64 touches the dorsal support 37.

FIG. 3 shows the adjustment device 58 having a body 62, an end of support 64 and two magnets 66 intended to be adjoined to an adjustment gauge which gives a length to the knife, for example 2,125 in. There is also a pair of antifriction ribs 68 and one railing guide 70 outside an elastic wall 72. On the top there is a sloping wall 73 defining an interior of the elastic wall 72. One sees a flexible countersink 74 surrounding a tightening conical element 76 activated by a conical set screw 78 which is driven by a hexagon Allen key 80.

FIG. 4 shows the adjustment device 58 opened; the elastic wall 72 comprises at its base a thin wall 84 for elasticity and for tensioning which will facilitate the spreading of the elastic wall 72. The position of the guide 70 will be moved outwardly by the spreading of the elastic wall 72 in order to widen a part of the adjustment device 58 for if required acting like an element of blocking. One sees also a threaded hole 85 which receives the conical set screw 78.

FIG. 5 A cut section is showing the tightening conical element 76 surmounting the elastic wall 72 comprising a tapered portion 86 against which the tightening element acts as a wedge causing a spreading displacement 88 thanks to the thin wall 84 which gives elasticity to a steel construction. The center is the threaded hole 85. The conical set screw 78 is bearing against the flexible countersink 74 for it to transmit pressure against the tapered portion 86 so as to spread the thin wall 84 and the elastic wall 72 in the direction of the arrows shown.

FIG. 6 The adjustment recess 52 is limited by two parallel walls of recess 92 comprising a female slide 90 intended to receive the guide 70; one notices also the tightening slot 55 overlapping the curved face 56 to let pass the curved mounting clamp 48. One notices also a part of a long face 51, the cutting edge 53 of the cutting angle 54 and the finishing face 57.

FIG. 7 The tightening conical element 76 is seen in perspective forming an oval whose interior face is a flexible countersink 74 intended to receive the conical set screw 78. A flat part 94 is intended to rest against the tapered portion 86 of the elastic wall 72.

FIG. 8 shows a bottom view of the curved mounting clamp 48 showing the curved surface 47 which is destined to be lean against on the inner seat 41. One sees also the two planes 96 and 98 of the curved mounting clamp 48.

SUMMARY OF THE INVENTION

Figure 1:
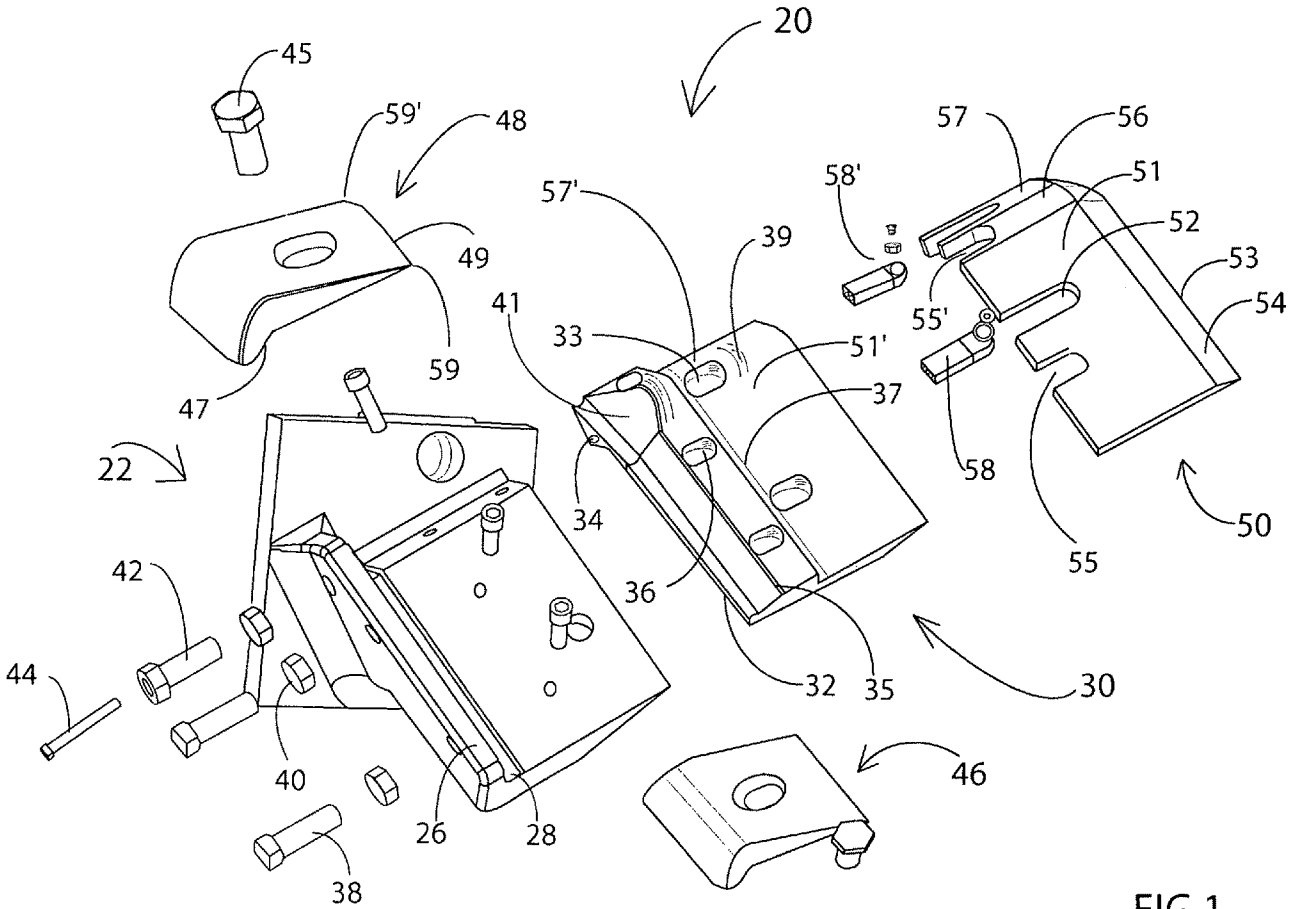
Figure 2:
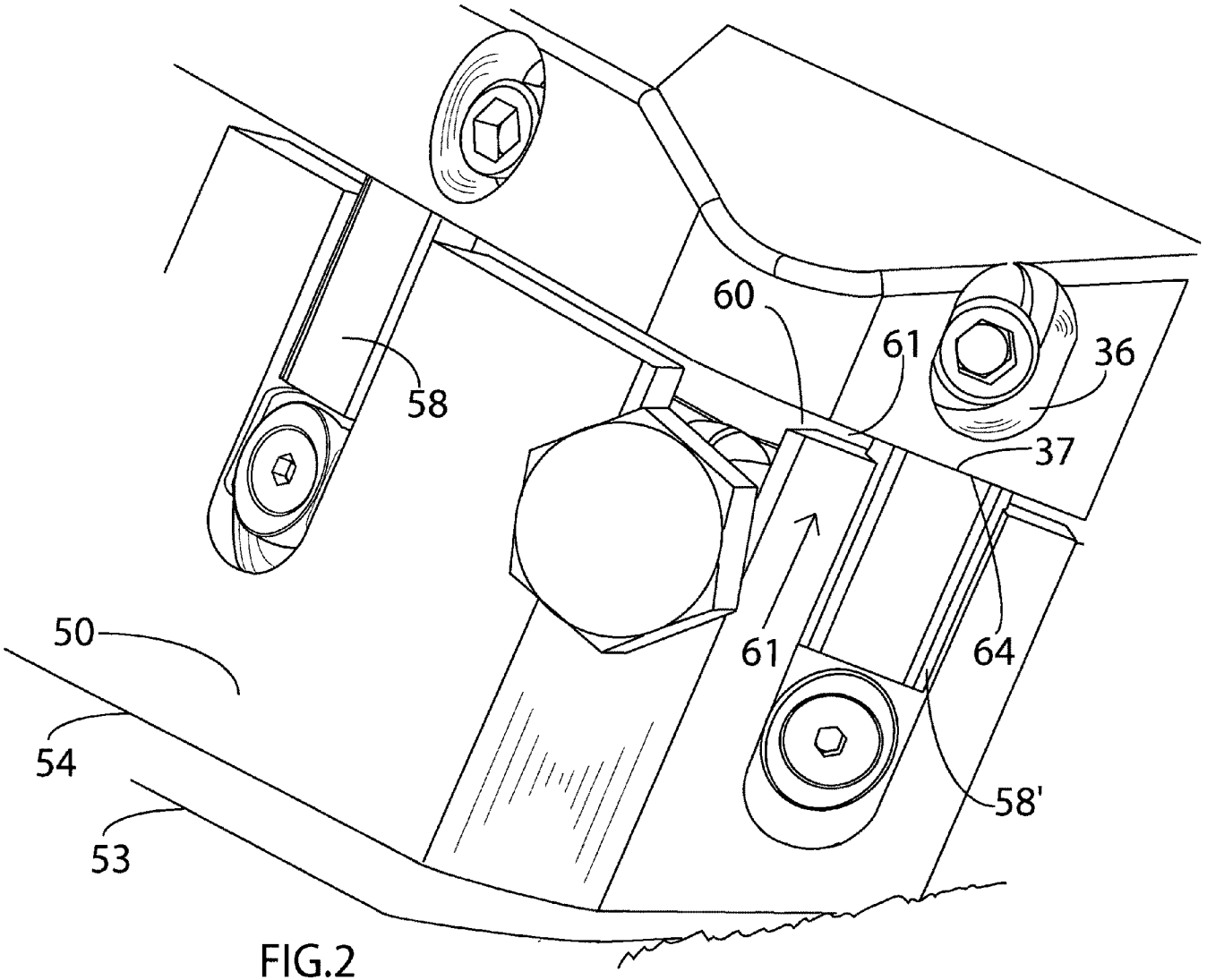
Figure 3:
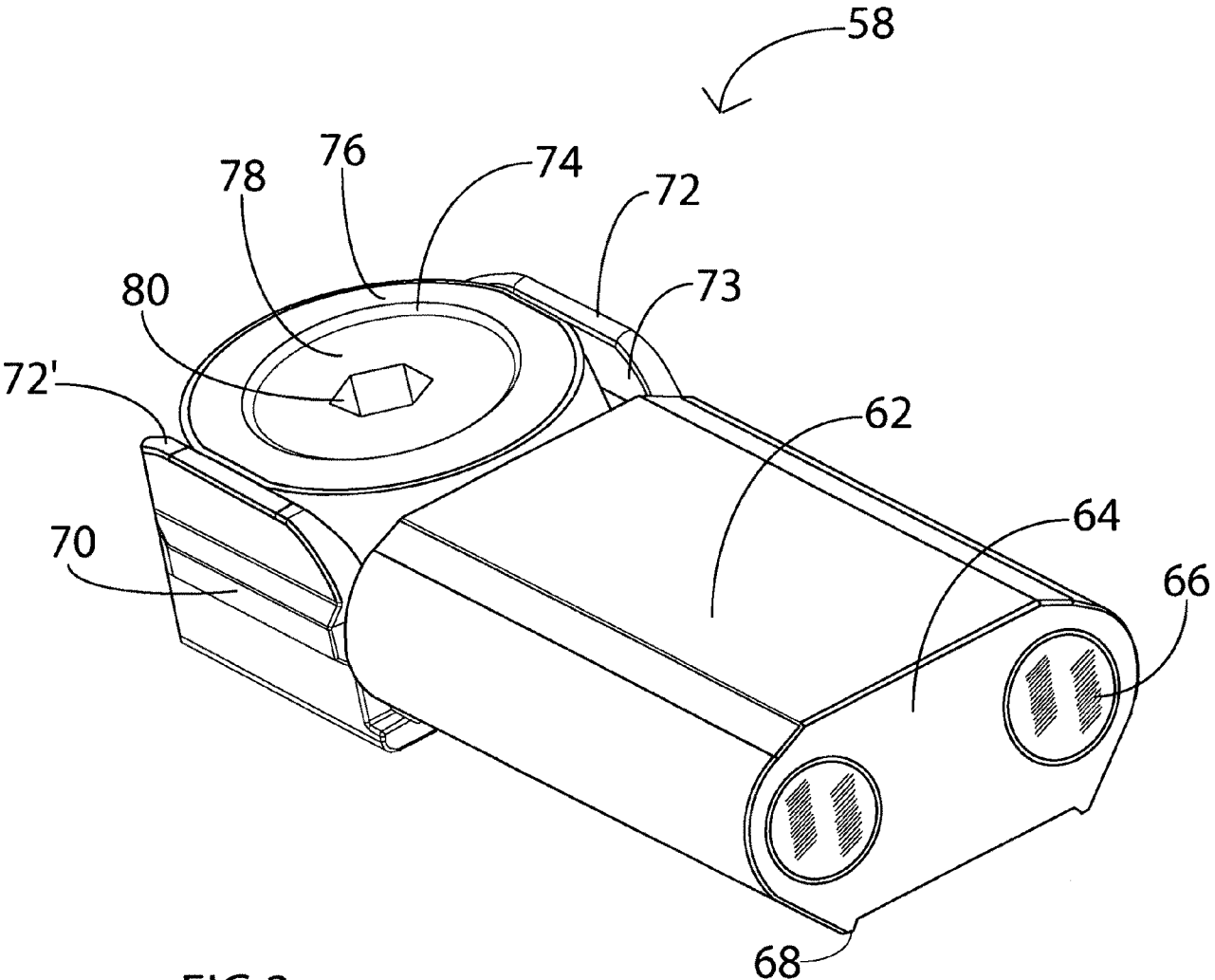
Figure 4:
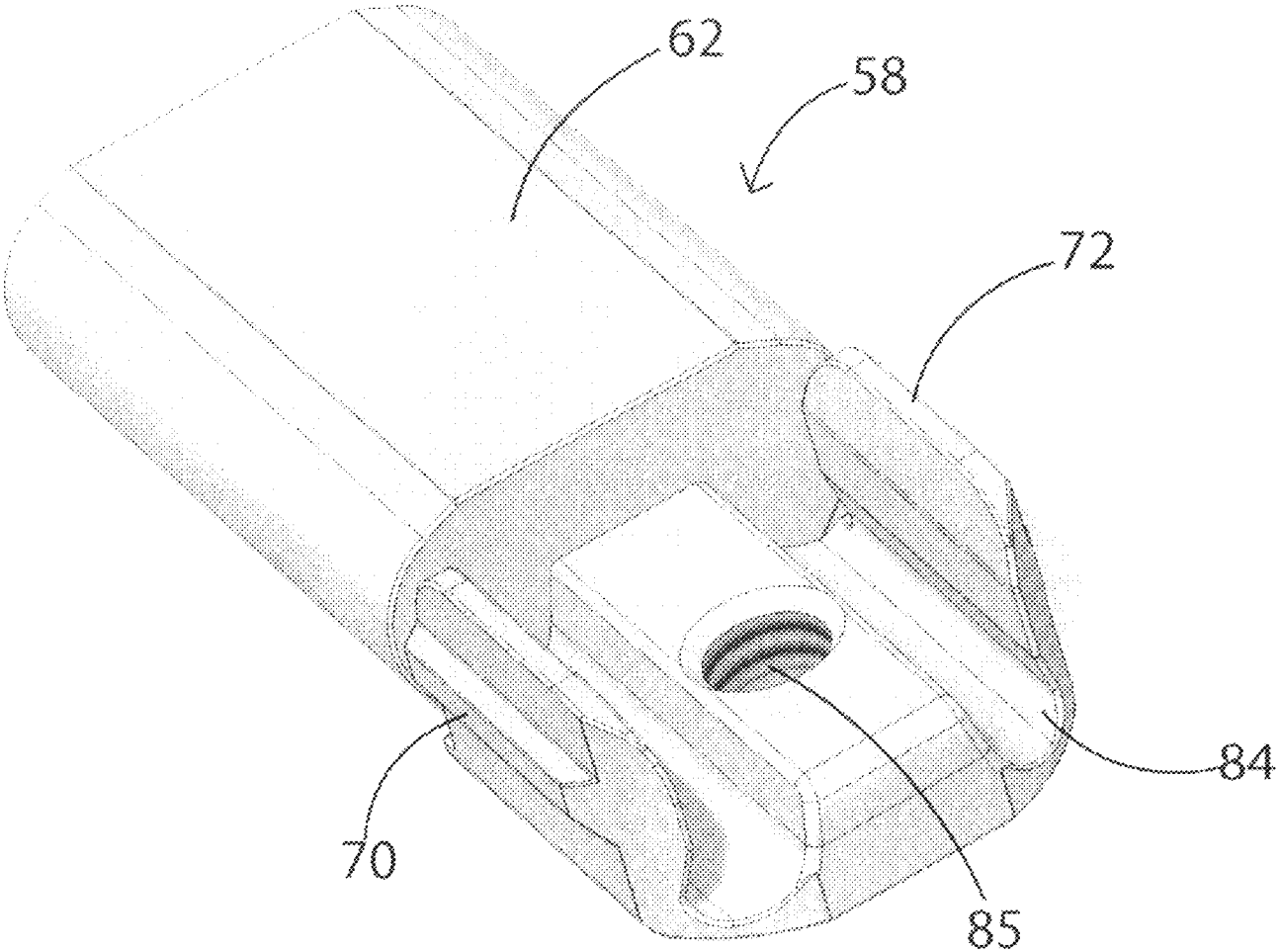
Figure 5:
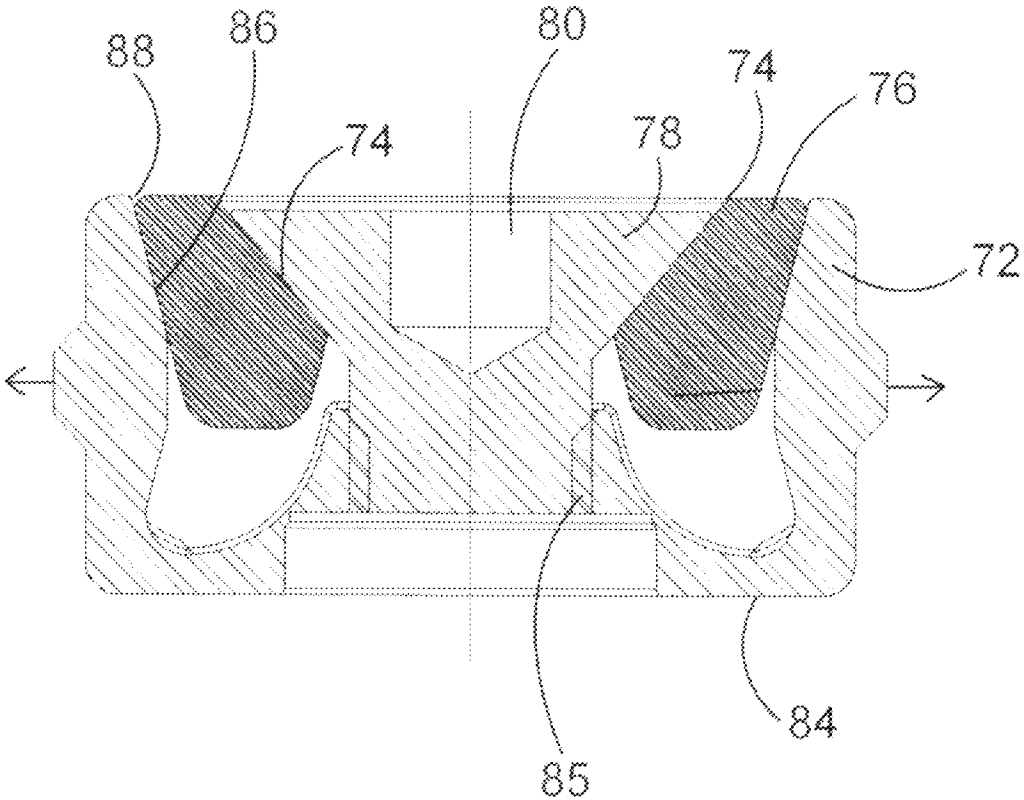
Figure 6:
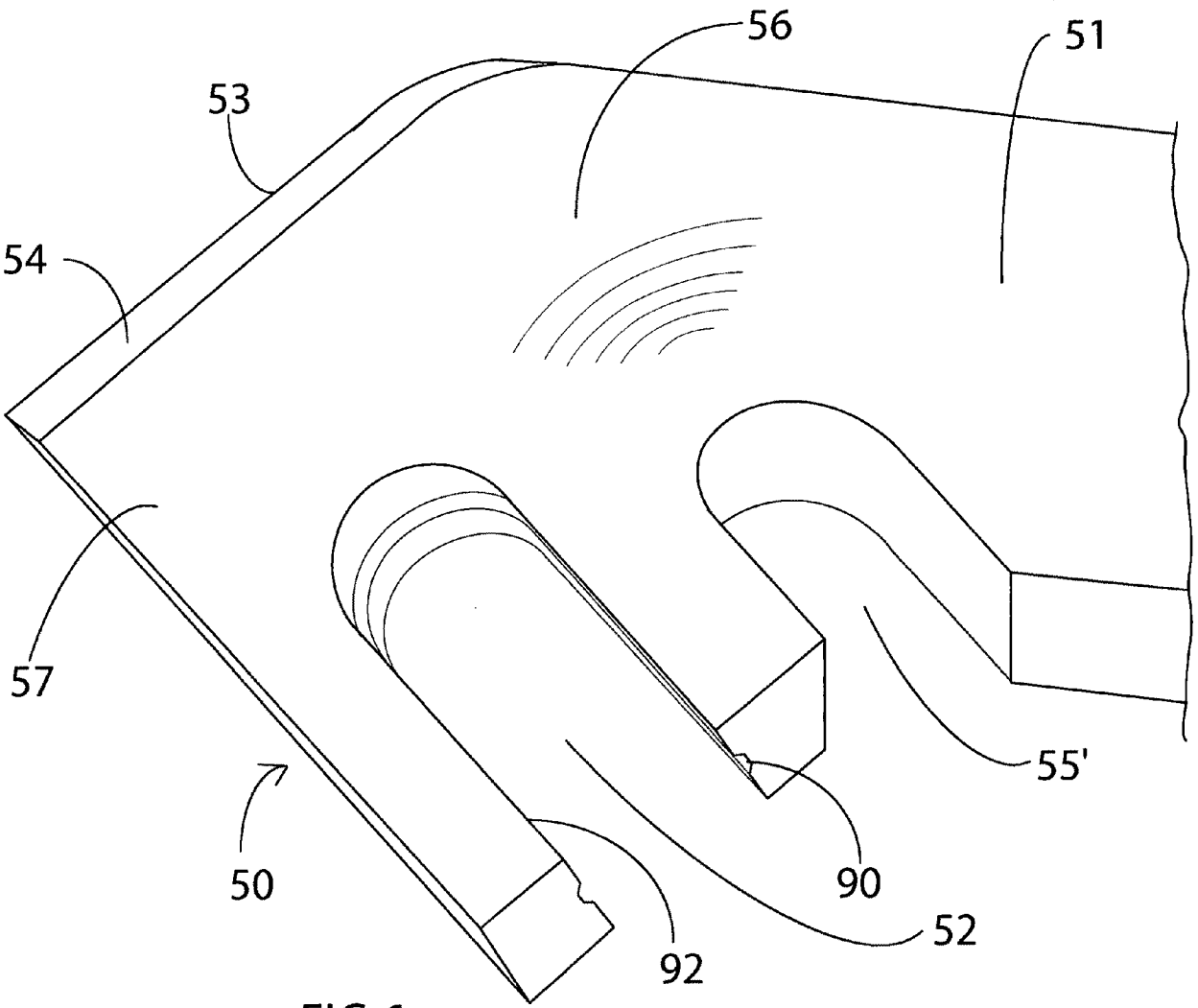
Figure 7:
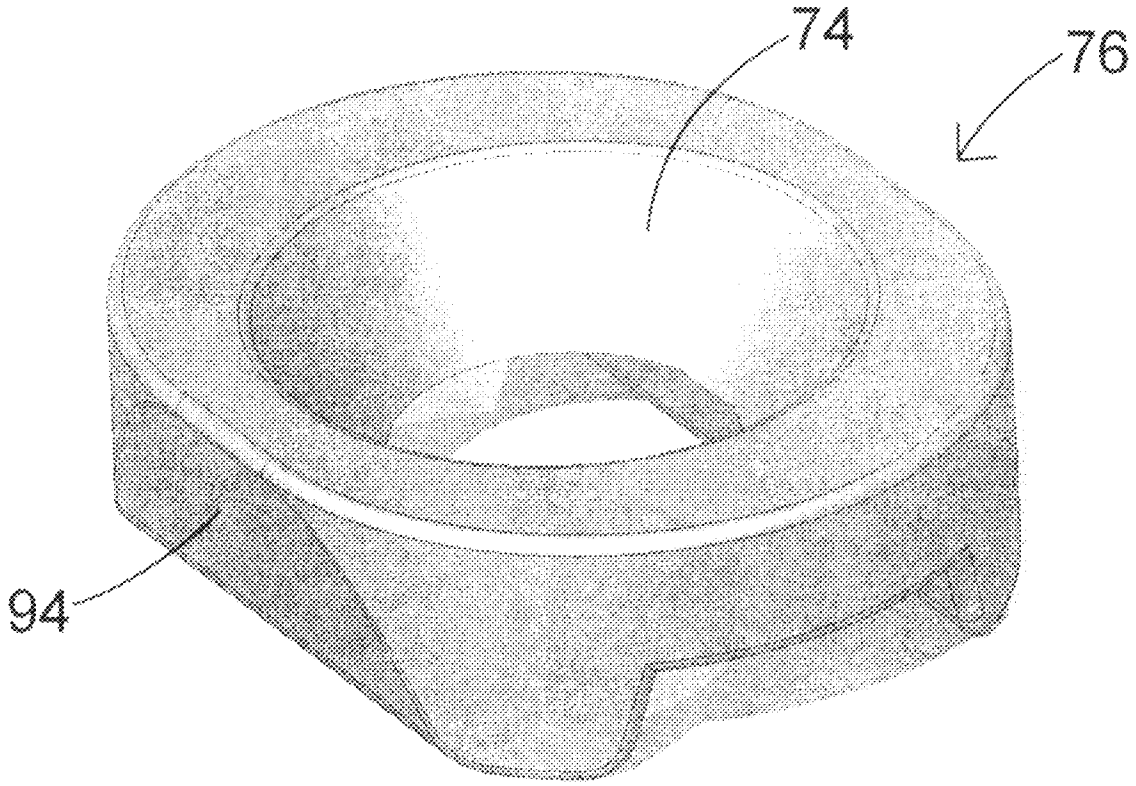
Figure 8:
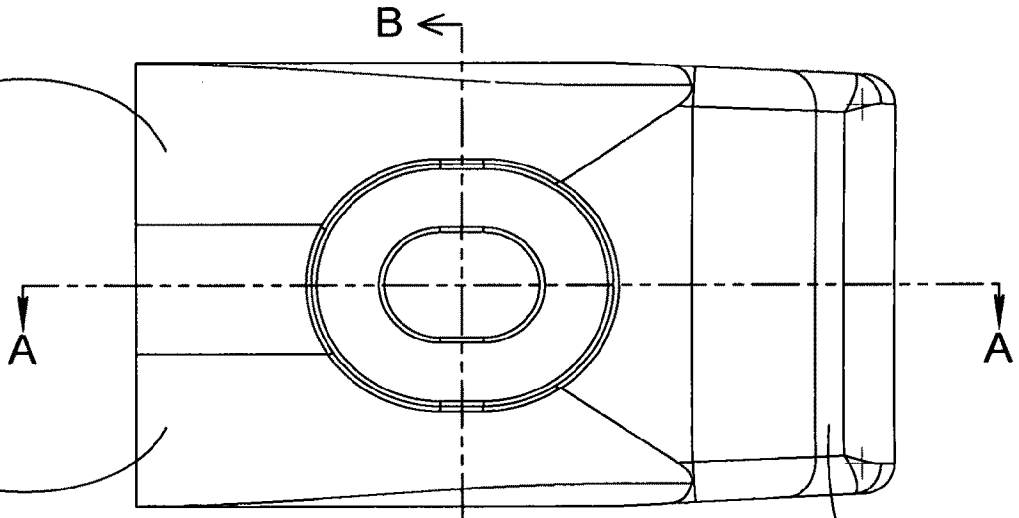
FIG. 8A shows a side view of the mounting clamp with its curved surface 47 destined to be laid on the outer seat of the counter knife.
FIG. 8B shows the planes 96 and 98 of the mounting clamp destined to be laid against the long face and the finishing face of the knife.
Figure 8A:
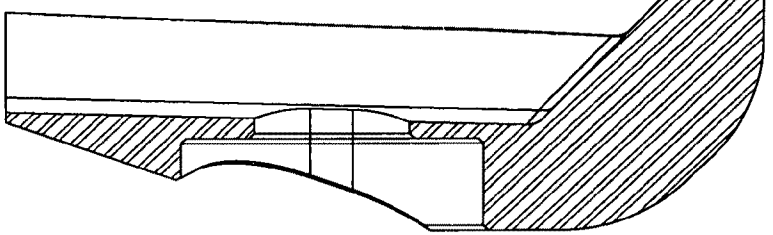
Figure 8B:
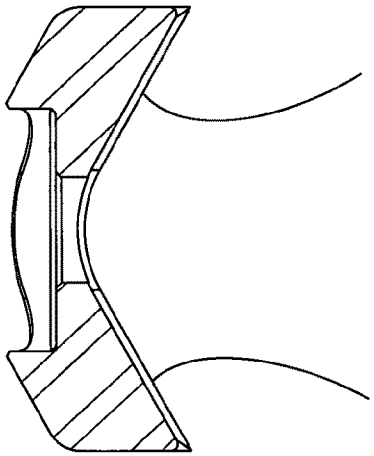

The present invention relates to a rotary tool of cut comprising a unit 20 of a fast canter head comprising a knife holder 22 with angle and carrying a counter knife 30 with elbow and a dorsal support 32 which in its turn positions a knife, cutting tool 50 with cutting angle 54. The cutting tool has a pair of recesses of adjustment 52 containing an adjustment device 58. This device comprises an end of support 64 which leans against the dorsal support and extensions to take account of the wear of the point of the knife, with adjustable position, making it possible to preserve the same rotation distance, even after grinding or polishing. The device has a guide 70 which slips into the recess 52 and which comprises an elastic wall 72 which permits the tightening against the sides of the recess by the push of a tightening conical element 76 activated by a conical set screw 78. In the event of shock, the guide slips.

APPLICATION

A rotary cutting tool comprising a fast canter head 20 comprising a knife holder 22 and carrying a counter knife 30 with a dorsal support 32 intended to position a knife 50, with cutting angle 54, the cutting tool having a pair of recesses of adjustment 52 containing an adjustment device 58 comprising an end of support 64 which leans against the dorsal support 32 to take account of the wear of the cutting edge 53 in an adjustable position, allowing to preserve the same rotation distance, after grinding, the device having a guide 70 which slips into recess 52 and comprises an elastic wall 72 which tightens against the sides of the recess by the push of a tightening conical element 76 activated by a conical set screw 78.

The knife holder 22 is directed with an angle.

The knife holder has an elbow.

The knife is a cutting tool.

An adjustment device 58 intended to compensate for a variable distance between a first dorsal support 32 and a second support near an operation of grinding or finishing, the device comprising:

an end of support 64 which leans against the first dorsal support 32, means of lengthening to take account of a variation of a limit of the second support in adjustable position, allowing to preserve the same distance, after grinding or polishing, a recess of adjustment 52 channeling the device, the device having a guide 70 which slips into the recess 52 and comprises an elastic wall 72 which tightens against the sides of the recess by the push of a tightening conical element 76 activated by a conical set screw 78.

It is to be clearly understood that the instant description with reference to the annexed drawing is made in an indicative manner and that the preferred embodiments described herein are meant in no way to limit further embodiments realizable within the scope of the invention. The matter which is claimed as being inventive and new is limited only by the following claims.

PARTS

20—Canter head
22—Knife holder
24—Support face
26—Retaining shoulder
28—Clearance slot
30—Counter knife
32—Back part
33—Elbow slot
34—Adjustment hole
35—Face of support
36—Oval locking slot
37—Dorsal support
38—Holding screw
39—Elbow
40—Blocking nut
41—Inner seat
42—First adjustment screw
44—Internal adjustment screw
45—Tightening screw
46—Straight mounting clamp
47—Curved surface
48—Curved mounting clamp
49—Angled part
50—Cutting knife
51—Long face of the knife
51'—Long face of the counter knife
52—Adjustment recess
53—Cutting edge
54—Cutting angle
55—Tightening slot
57—Finishing face
57'—Angularly orientated face
58—Adjustment device
58'—Adjustment device on finishing face
59—Elastic sides
60—Back of knife
61—Wear gap
62—Body
64—End of support
66—Magnet
68—Antifriction rib
70—Railing guide
72—Elastic wall
73—Sloping wall
74—Countersink
76—Tightening conical element

78—Conical set screw
80—Allen key
84—Thin wall
85—Threaded hole
86—Tapered portion
88—Spreading displacement
90—Female slide
92—Wall of recess
94—Flat part
96—Plane destined to long face
98—Plane destined to finishing face

We claim:

1. A cutting tool adapted to deliver a peripheral cut at a constant radial distance, said cutting tool comprising a multi stage canter head (20), said canter head comprising a knife holder (22), a counter knife (30) mounted on said knife holder, said counter knife having a dorsal support (37), a cutting knife (50) mounted on said dorsal support and having a cutting edge (53), said cutting knife further having a pair of adjustment recesses (52) adapted to sustain means of adjustment device (58);

said cutting knife further comprising a long face (51), a sharp cutting face (54), a short angularly oriented finishing face (57) and a curved face (56) laid out between said sharp cutting face (54) and said finishing face (57);

said counter knife (30) also comprising an angularly orientated face (57'), a long face (51') and an elbow (39), between said long face (51') and said angularly oriented face (57'), said elbow (39) fitting said curved face (56), said elbow comprising an elbow slot (33), said cutting tool comprising means of clamping (48) said cutting knife onto said counter knife, said means of clamping (48) comprising an angled part (49) and a curved surface (47) installed over said elbow slot (33) onto said elbow in combination with a tightening screw (45) tightening said angled part, said angled part (49) comprising outside edges (59) tightened against said long face (51) and said finishing face (57), the tightening by said tightening screw (45) against said long face (51) and said finishing face (57) causing a spread of said outside edges and a firm holding of said knife, said means of clamping exerting a push against three elements namely two planes (51, 57), by the spreading of said outside edges (59), and a surface of an inner seat (41) against said curved surface (47), thereby forcing a cooperation of said three elements.

* * * * *